US005129555A

United States Patent [19]

Fricker

[11] Patent Number: 5,129,555

[45] Date of Patent: Jul. 14, 1992

[54] REROUTING MECHANISM FOR TRANSFERRING MOVEMENT OF A DRIVING MEMBER TO A MOVABLE PLATE OF A SLIDE GATE

[75] Inventor: Robert Fricker, Weggis, Switzerland

[73] Assignee: Stopinc Aktiengesellschaft, Baar, Switzerland

[21] Appl. No.: 649,462

[22] Filed: Feb. 5, 1991

[30] Foreign Application Priority Data

Feb. 7, 1990 [CH] Switzerland ..... 00384/90

[51] Int. Cl.[5] ..... B22D 41/08

[52] U.S. Cl. ..... 222/600; 266/236

[58] Field of Search ..... 222/600, 590, 591, 597; 266/236

[56] References Cited

U.S. PATENT DOCUMENTS 3,841,538 10/1974 Bode, Jr. ..... 222/600

4,421,256 12/1983 Abarotin et al. ..... 222/600

FOREIGN PATENT DOCUMENTS 2545514 4/1976 Fed. Rep. of Germany .

0505520 7/1976 U.S.S.R. ..... 222/600

88/01211 2/1988 World Int. Prop. O. .

*Primary Examiner*—Scott Kastler

*Attorney, Agent, or Firm*—Wenderoth, Lind & Ponack

[57] ABSTRACT

A rerouting mechanism is used in an assembly including a driven member movable in a driven direction to operate the movable plate of a slide gate and drive unit for moving the driven member in the driven direction and including a drive member movable in a driving direction out of alignment with the driven direction. The rerouting mechanism transfers movement of the driving member in the driving direction to movement of the driven member in the driven direction. The rerouting mechanism includes a guide member defining a bent guideway aligned with the driving direction and the driven direction. A flexible force transfer element is positioned within the guideway and is movable therealong while flexibly deforming to the configuration thereof. The transfer element has opposite ends connected to the driving member and to the driven member. Upon movement of the driving member in the driving direction, the transfer element forcibly is moved along the guideway while the transfer element flexibly deforms to the configuration of the guideway. At the same time, the driven member is moved in the driven direction.

24 Claims, 1 Drawing Sheet

REROUTING MECHANISM FOR TRANSFERRING MOVEMENT OF A DRIVING MEMBER TO A MOVABLE PLATE OF A SLIDE GATE

BACKGROUND OF THE INVENTION

The present invention relates to a rerouting mechanism for use in transferring the movement of a driving member in a driving direction to a driven member in a driven direction out of alignment with the driving direction, the driven member operating a movable plate of a slide gate or a sliding enclosure unit for use in controlling the discharge of molten metal from a metallurgical vessel.

As is known, a movable plate of a slide gate is moved by a driven member, for example, a thrust rod, in a driven direction, particularly, rectilinearly, by a drive unit including a driving member that is movable in a driving direction. Typically the driving unit is a hydraulic cylinder that includes a driving member in the form of a piston rod that is moved rectilinearly. It furthermore is known that it normally is not possible to align the rectilinear piston rod of the hydraulic cylinder with the rectilinear thrust rod that moves the movable plate of the slide gate. This is due to a number of factors, for example lack of available space as well as to the danger of subjecting the drive unit to severe heat radiation. As a result, it is known to mount the drive unit itself, for example in a hinged manner, at a separate location, for example on the side of the metallurgical vessel. The direction of movement of the driving member of the drive unit therefore is out of alignment with the thrust rod or other mechanism that moves the movable plate of the slide gate. It therefore is necessary to provide a rerouting mechanism between the drive unit and the thrust rod to transfer movement of the driving member in a driving direction to movement of the driven member in a driven direction, such two directions being out of alignment.

A typical known such rerouting mechanism is disclosed in German DE-OS 25 45 514. This mechanism provides a substantially triangular member or guide that operates essentially in the manner of a bell crank hinged to the wall of the metallurgical vessel and to a driving member of the drive unit, for example a piston rod of a hydraulic cylinder-piston unit, and to a pressure-thrust rod for achieving movement of a movable plate of the slide gate. This known arrangement however has the significant disadvantage that the forces imparted to the pressure-thrust rod for moving the movable plate are not strictly in the rectilinear direction of movement of the movable plate. Rather, such forces include, depending upon the relative position of the mechanism, significant cross forces. As a result, the stroke of movement of the movable plate is limited. Addition, it is difficult to achieve a constant, precise transfer of motion to the movable plate.

SUMMARY OF THE INVENTION

With the above discussion in mind, it is an object of the present invention to provide an improved rerouting mechanism whereby it is possible to overcome the above and other prior art disadvantages.

It is a further object of the present invention to provide such a rerouting mechanism wherein all of the forces of the drive unit are transferred in a precise manner directly aligned with the intended direction of movement of the movable plate of the slide gate.

It is any even further object of the present invention to provide such a rerouting mechanism in combination with a driven member for use in moving a movable plate of a slide gate and also in combination with a drive unit for moving such movable member.

The above and other objects are achieved in accordance with the present invention by the provision that the rerouting mechanism comprises a guide member defining a bent guideway aligned with the driving direction of the drive unit and the driven direction of movement of the driven member to move the movable plate of the slide gate. A flexible force transfer element is positioned within the guideway and is movable therealong while flexibly deforming to the configuration thereof. The transfer element has opposite ends connected to the driving member of the drive unit and to the driven member intended to move the movable plate of the slide gate. Accordingly, movement of the driving member in the driving direction forcibly moves the transfer element along the guideway while the transfer element selectively deforms to the configuration of the guideway. This in turn causes the driven member to be moved in the driven direction. As a result of the above structural arrangement, all of the forces of the driving member, particularly, rectilinear, are transferred in a precise and accurate manner to the driven member in exactly the intended direction of movement thereof to achieve operation of the movable plate of the slide gate.

The above structural features of the present invention offer a simple and space saving construction that can be used with substantially no modification in a number of different attachment situations, and particularly in existing systems. The rerouting mechanism transfers forces in a totally rectilinear manner, and as a result the thrust rod or driven member that moves the movable plate of the slide gate is not subjected to any cross forces at any time. The stroke of movement of the drive unit is not in any way limited, and the entire stroke of movement thereof is transferred to the driven unit. Thus, greater stroke lengths of the driven member are possible. This particularly is advantageous in a shutoff construction that requires a movement stroke beyond a normal closing position in order to be able to swivel a pusher-thrust unit away from a shutoff housing for the purpose of replacing various plates of a shutoff assembly, for example a slide gate. In this regard, attention is directed to International application publication No. WO 88/01211.

It particularly is contemplated that the flexible transfer element may be in the form of a roller chain or a flexible cable, for example a steel cable. The guideway may be smoothly curved or may be formed of rectilinear segments extending at angles to each other.

BRIEF DESCRIPTION OF THE DRAWINGS

Other objects, features and advantages of the present invention will be apparent from the following detailed description of a preferred embodiment thereof, with reference to the accompanying drawings, wherein.

DETAILED DESCRIPTION OF THE INVENTION

Figure 1:
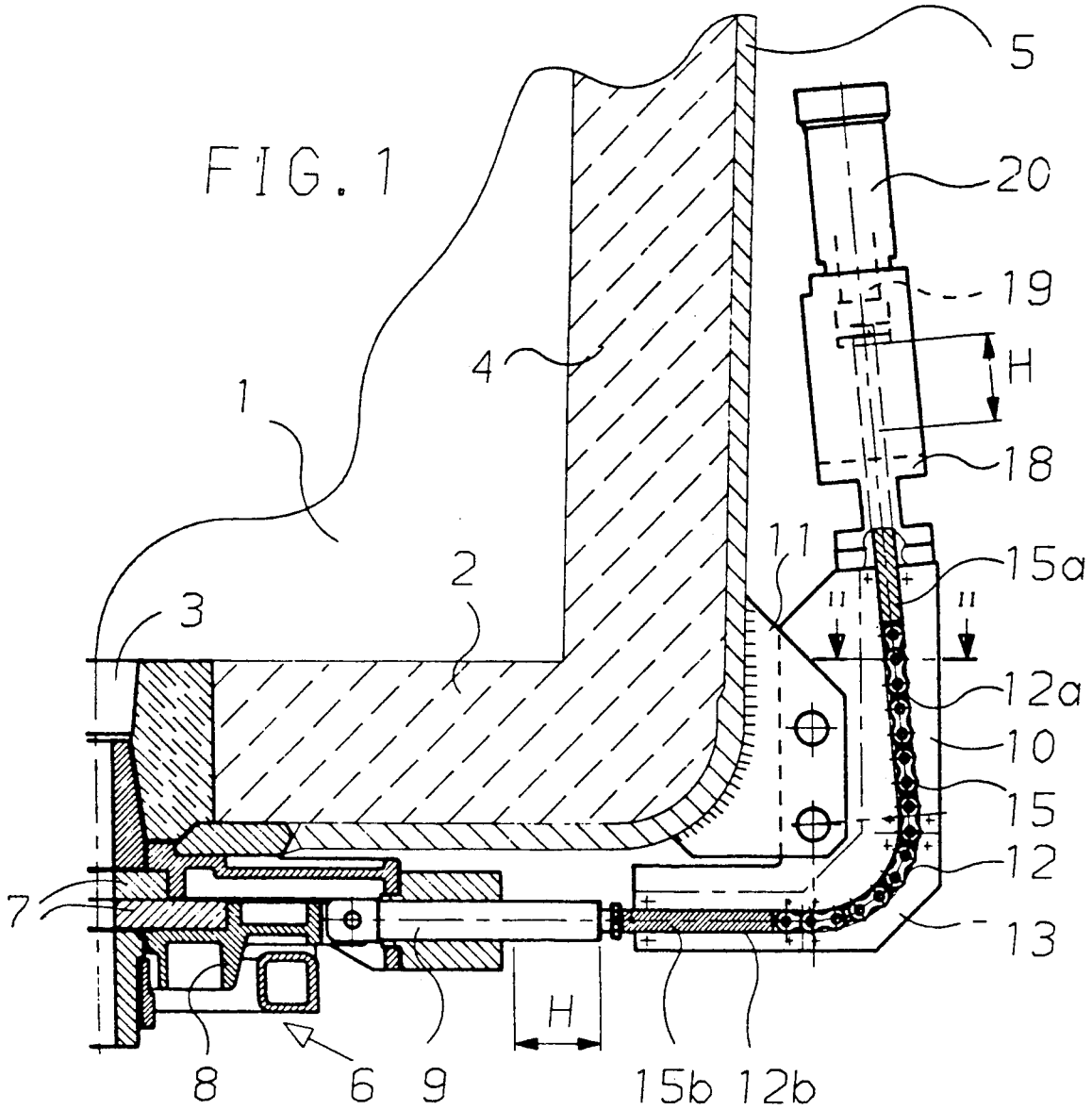
FIG. 1 is a partial sectional view of part of a metallurgical vessel equipped with a slide gate that has associated therewith a rerouting mechanism in accordance with one embodiment of the present invention.

In FIG. 1 there is shown somewhat schematically a portion of the bottom of a metallurgical vessel 1, for example, a casting vessel such as a ladle containing molten steel. Vessel 1 includes a conventional bottom 2 and side 4 formed in a normal manner of a refractory lining enclosed by a steel shell 5. Extending through bottom 2 is a discharge opening 3 equipped with a conventional slide gate or sliding closure unit 6 (only half of which is illustrated in the open position). The slide gate includes stationary and movable plates 7, and movable plate 7 is moved between open and closed positions by means of a carriage or housing assembly 8 movable in opposite rectilinear directions by a pressure-thrust rod 9 over a stroke H.

This movement is initiated by a drive unit 20, for example, a dual acting, hydraulic cylinder-piston unit. Drive unit 20 is attached adjacent the exterior of vessel wall 4. A drive rod 19 of drive unit 20 moves in a direction out of alignment with the direction of movement of rod 9.

Figure 2:
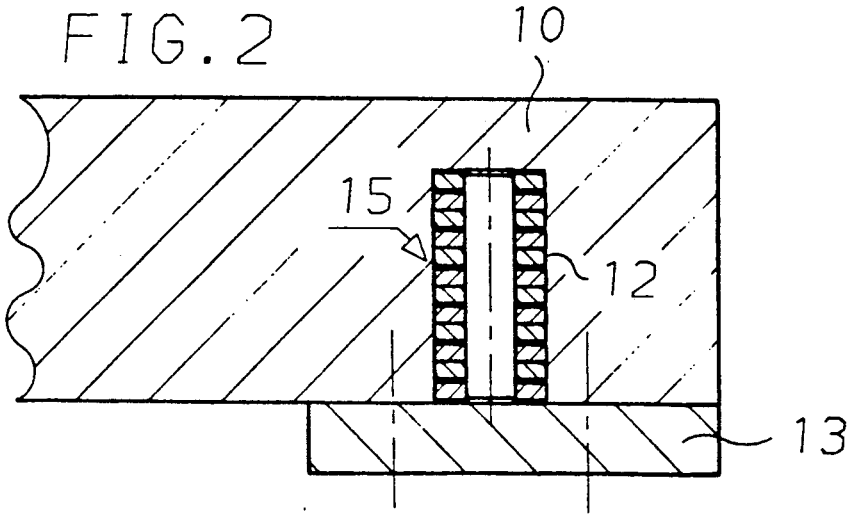
FIG. 2 is a partial sectional view, on an enlarged scale, along line II—II of FIG. 1.

Accordingly, it is apparent that it is necessary to provide a rerouting mechanism to transfer the rectilinear movement of rod 19 in the driving direction to rectilinear movement of rod 9 in the driven direction. This is achieved by the rerouting mechanism of the present invention that includes a guide member 10 removably mounted to straps 11 welded to vessel shell 5. Guide member 10 defines a bent guideway 12 having opposite ends aligned with the axis of rod 19 and with the axis of rod 9. In the illustrated arrangement, with particular reference to FIG. 2, the guideway 12 is a recess formed in guide member 10 and having an open side. Such open side may be closed by one or more cover members 13 that are removably attached to guide member 10. In the illustrated arrangement, guideway 12 includes a smoothly curved center section and opposite first and second rectilinear end sections 12*a*, 12*b*.

A flexible force transfer element 15 is positioned within guideway 12 and is movably therealong while flexibly deforming to the configuration thereof. Transfer element 15 has opposite ends connected to driving rod 19 and driven rod 9. As a result, movement of driving rod 19 in the driving direction forcibly moves transfer element 15 along guideway 12, while transfer element 15 flexibly deforms to the configuration of guideway 12, and this in turn moves driven rod member 9 in the driven direction thereof.

In the illustrated arrangement, transfer element 15 includes a flexible center section that is movable along the entire length, if necessary, of guideway 12. Connected to this flexible center section are opposite end sections in the form of rigid rectilinear rods 15*a*, 15*b* that are movable in respective rectilinear end sections 12*a*, 12*b* of the guideway 12. In the illustrated arrangement the drive unit 20 is attached to guide member !0, for example by means of a subcarrier 18 attached to guide element 10 in an extension of end section 12*a*. Between the cylinder of drive unit 20 and carrier 18, and also between piston rod 19 and rod 15*a* are provided well-known claw connections so that the drive unit 20 easily may be attached to and removed from guide member 10. Rod 15*b* is detachably connected to thrust rod 9, for example by means of cotter pins or a screw connection. It also is contemplated however that drive unit 20 could be removably mounted directly to vessel shell 5.

When pressure rod 9 is moved by drive unit 20 in opposite closing and opening directions, friction is produced between transfer element 15 and guideway 12. However, no cross forces at all are imparted to either driven thrust rod 9 or driving piston rod 19. Movement is transferred entirely linearly over the entire stroke length H, and all movement of rod 19 is transferred to rod 9. Even larger stroke lengths are possible without additional effort by the guided lengths of rods 15*a*, 15*b* in the straight end sections of the guideway. The angle of rerouting, i.e. the angle between the axes of rods 19 and 9, is generally approximately 90°, but can deviate therefrom, depending on the requirements of a particular installation, without additional effort. The rerouting mechanism of the present invention easily can be mounted on the exterior of vessel 1 and brought into alignment with the direction of movement of the movable plate of the slide gate 6. Fixing of positioning may be achieved by set pins or the like. If necessary or desirable, it also in principle would be possible to attach the mechanism in a position completely below the vessel bottom, i.e. in a position pivoted by 90° around the axis of rod 9 with respect to the arrangement shown in FIG. 1, with guideway 12 then extending in a horizontal plane.

Bent guideway 12 is illustrated as being part of a circle. It is to be understood however that the configuration could be otherwise, for example such as part of an ellipse, or other curved configurations. Furthermore, guideway 12 could be formed by two or more rectilinear segments inclined to each other at angles such that adjacent pairs of such segments each define an obtuse angle.

Furthermore, the present invention is not limited to a drive unit 20 being the illustrated cylinder-piston unit. Other types of drive units, such as spindle drives or the like are employable. Additionally, however, it is contemplated that the present invention be employable with drive units having a driving member that moves in a rotating manner rather than a rectilinear manner, for example a pinion mating with a toothed rack or a chain wheel mating with a chain forcibly guided in the guideway.

Although the present invention has been described and illustrated with respect to preferred features thereof, it is to be understood that additional modifications and changes may be made to the specifically described and illustrated features without departing from the scope of the present invention.

I claim:

1. In an assembly for operating a movable plate of a slide gate for controlling the discharge of molten metal from a metallurgical vessel, said assembly comprising a driven member movable in a rectilinear driven direction to operate the movable plate, a drive unit for moving said driven member in said driven direction and including a driving member movable in a rectilinear driving direction out of alignment with said driven direction, and a rerouting mechanism for transferring movement of said driving member in said driving direction to movement of said driven member in said driven direction, the improvement wherein said rerouting mechanism comprises:

a guide member defining a bent guideway including a bent center section, a first rectilinear end section aligned with said driving direction, and a second rectilinear end section aligned with said driven direction; and a flexible force transfer element positioned within said guideway and movable therealong while flexibly deforming to the configuration thereof, said transfer element including a flexible center section movable in said center and said end sections of said guideway and rigid rectilinear first and second opposite end sections movable in said first and second end sections, respectively, of said guideway, said first and second opposite end sections being connected to said driving member and to said driven member, respectively, such that movement of said driving member in said driving direction forcibly moves said first end section of said transfer element along and in said first end section of said guideway while said center section of said transfer element flexibly deforms to the configuration of said guideway and thereby moves said second end section of said transfer element along and in said second end section of said guideway, thus moving said driven member in said driven direction.

2. The improvement claimed in claim 1, wherein said driving member comprises a drive rod of a dual-acting hydraulic cylinder.

3. The improvement claimed in claim 1, wherein said driven member comprises a thrust rod.

4. The improvement claimed in claim 1, wherein said rigid opposite end sections of said transfer element comprise rods connected to opposite ends of said flexible center section of said transfer element.

5. The improvement claimed in claim 1, wherein said guideway comprises a groove formed in said guide member.

6. The improvement claimed in claim 5, wherein said groove has an open side, and further comprising detachable means closing said open side of said groove and thereby enclosing said guideway.

7. The improvement claimed in claim 1, wherein said transfer element comprises a roller chain.

8. The improvement claimed in claim 1, wherein said transfer element comprises a steel cable.

9. The improvement claimed in claim 1, wherein said drive unit is mounted on said guide member.

10. The improvement claimed in claim 1, further comprising means for removably mounting said guide member on the metallurgical vessel.

11. The improvement claimed in claim 1, wherein said guideway is curved.

12. The improvement claimed in claim 11, wherein said curved guideway defines part of a circle.

13. The improvement claimed in claim 11, wherein said curved guideway defines part of an ellipse.

14. The improvement claimed in claim 1, wherein said guideway is defined by rectilinear segments inclined to each other such that adjacent said segments define an obtuse angle.

15. A rerouting mechanism for use in an assembly including a driven member movable in a rectilinear driven direction to operate the movable plate of a slide gate and a drive unit for moving the driven member in the driven direction and including a driving member movable in a rectilinear driving direction out of alignment with the driven direction, for transferring movement of the driving member in the driving direction to movement of the driven member in the driven direction, said rerouting mechanism comprising:

a guide member defining a bent guideway including a bent center section, a first rectilinear end section to be aligned with the driving direction, and a second rectilinear end section to be aligned with the driven direction; and a flexible force transfer element positioned within said guideway and movable therealong while flexibly deforming to the configuration thereof, said transfer element including a flexible center section movable in said center and said end sections of said guideway and rigid rectilinear first and second opposite end sections movable in said first and second end sections, respectively, of said guideway, said first and second opposite end sections to be connected to the driving member and to the driven member, respectively, such that upon movement of the driving member in the driving direction said first end section of said transfer element forcibly moves along and in said first end section of said guideway while said center section of said transfer element flexibly deforms to the configuration of said guideway and thereby moves said second end section of said transfer element along and in said second end section of said guideway, thus enabling movement of the driven member in the driven direction.

16. A mechanism as claimed in claim 15, wherein said rigid opposite end sections of said transfer element comprise rods connected to opposite ends of said flexible center section of said transfer element.

17. A mechanism as claimed in claim 15, wherein said guideway comprises a groove formed in said guide member.

18. A mechanism as claimed in claim 17, wherein said groove has an open side, and further comprising detachable means closing said open side of said groove and thereby enclosing said guideway.

19. A mechanism as claimed in claim 15, wherein said transfer element comprises a roller chain.

20. A mechanism as claimed in claim 15, wherein said transfer element comprises a steel cable.

21. A mechanism as claimed in claim 15, wherein said guideway is curved.

22. A mechanism as claimed in claim 21, wherein said curved guideway defines part of a circle.

23. A mechanism as claimed in claim 21, wherein said curved guideway defines part of an ellipse.

24. A mechanism as claimed in claim 15, wherein said guideway is defined by rectilinear segments inclined to each other such that adjacent said segments define an obtuse angle.

* * * * *